US011705657B2

(12) United States Patent
Hung et al.

(10) Patent No.: US 11,705,657 B2
(45) Date of Patent: Jul. 18, 2023

(54) ELECTRICAL CONNECTOR

(71) Applicant: Dongguan Luxshare Technologies Co., Ltd, Dongguan (CN)

(72) Inventors: Yung-Chih Hung, Taipei (TW); RongZhe Guo, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 1 day.

(21) Appl. No.: 17/364,250

(22) Filed: Jun. 30, 2021

(65) Prior Publication Data

US 2022/0006225 A1 Jan. 6, 2022

(30) Foreign Application Priority Data

Jul. 3, 2020 (CN) ..... 202021274588.7

(51) Int. Cl.

| | |
|---|---|
| ***H01R 13/18*** | (2006.01) |
| *H01R 43/02* | (2006.01) |
| *H01R 13/64* | (2006.01) |
| *H01R 43/18* | (2006.01) |
| *H01R 4/72* | (2006.01) |

(52) U.S. Cl.

CPC ..... *H01R 13/18* (2013.01); *H01R 4/72* (2013.01); *H01R 13/64* (2013.01); *H01R 43/0263* (2013.01); *H01R 43/18* (2013.01)

(58) Field of Classification Search

CPC ..... H01R 13/18

See application file for complete search history.

(56) References Cited

U.S. PATENT DOCUMENTS

| | | | | |
|---|---|---|---|---|
| 10,050,395 | B2 * | 8/2018 | Ngo | H01R 13/6275 |
| 10,374,334 | B2 * | 8/2019 | Li | H01R 9/16 |
| 10,396,482 | B2 * | 8/2019 | Glick | H01R 43/16 |

FOREIGN PATENT DOCUMENTS

| | | |
|---|---|---|
| CN | 205724101 U | 11/2016 |
| CN | 207994129 U | 10/2018 |
| CN | 208256918 U | 12/2018 |

* cited by examiner

*Primary Examiner* — Ross N Gushi

(74) *Attorney, Agent, or Firm* — Birch, Stewart, Kolasch & Birch, LLP

(57) ABSTRACT

The present disclosure provides an electrical connector comprising an insulating body, a terminal component, and a fixing component. The insulating body comprises a mating slot. The terminal component is disposed in the mating slot. The terminal component comprises a pair of first terminal members and a pair of second terminal members. The pair of first terminal members are disposed between the pair of second terminal members. Each of the first terminal members comprises a plurality of first elastic contacting parts and a cable connecting part. Each of the second terminal members comprises a plurality of second elastic contacting parts. The plurality of second elastic contacting parts correspondingly abut against the plurality of first elastic contacting parts. The fixing component fixes the pair of the first terminal members and the pair of the second terminal members. A cable is directly connected to each of the cable connecting parts.

12 Claims, 7 Drawing Sheets

ELECTRICAL CONNECTOR

CROSS-REFERENCE TO RELATED APPLICATION

This application claims the priority benefit of Chinese Patent Application Serial Number 202021274588.7, filed on Jul. 3, 2020, the full disclosure of which is incorporated herein by reference.

BACKGROUND

Technical Field

The present disclosure relates to the technical field of connector, particularly to an electrical connector comprising a component that increases terminal retention.

Related Art

Generally, the BUS conductive plate is provided with a copper or aluminum bar for electrical connection. The electrical connector for BUS conductive plate comprises two rows of terminals oppositely disposed. When the electrical connector is plugged onto the BUS conductive plate, it would be biased on the copper bar of the two rows of the terminals of the BUS conductive plate, allowing the electrical connector to be contactable/uncontactable and pluggable/unpluggable. Conventional electrical connectors for the BUS conductive plate are provided with a retaining member on the outer side of the two rows of opposed terminals. The retaining member would increase the retaining force of the bias of the terminal on the BUS conductive plate. However, only one metal plate is designed for conventional retaining members to cover all the terminals, which could not respectively provide retention force for different deformation of individual terminals. Another type is a C-shaped component comprising an upper and a lower retaining member formed by bending a whole piece of metal plate, which is difficult for assembling. Besides, conventional terminals are provided with a symmetrical clamping component to clamp the cable, with necessary fasteners to buckle with the clamping component to connect with the terminal and the cable. Thus, the assembling process would be complicated due to the complicated structures described above.

SUMMARY

The embodiments of the present disclosure provide an electrical connector tended to solve the problem that the retaining force provided by the retaining member of the electrical connector currently used for the BUS conductive plate and the problem of difficulties and complicated process of assembling of the retaining member of the electrical connector.

The present disclosure provides an electrical connector, comprising an insulating body, a terminal component, and a fixing component. The insulating body comprises a mating slot. The terminal component is disposed in the mating slot. The terminal component comprises a pair of first terminal members and a pair of second terminal members. The pair of first terminal members are disposed between the pair of second terminal members. Each of the first terminal members comprises a plurality of first elastic contacting parts and a cable connecting part. Each of the second terminal members comprises a plurality of second elastic contacting parts.

The plurality of second elastic contacting parts correspondingly abut against the plurality of first elastic contacting parts. The fixing component fixes the pair of the first terminal members and the pair of the second terminal members. A cable is directly connected to each of the cable connecting parts.

In the embodiments of the present disclosure, the copper bar is clamped by the first terminal member to be disposed between the second terminal members. The second elastic contacting part of the second terminal member correspondingly abuts against the first elastic contacting part of the first terminal member. In this way, the second terminal member could apply a retaining force to the first terminal member, allowing the first terminal member can be kept in contact with the copper bar. Besides, since the retaining force to each of the first elastic contacting parts is respectively provided by individual second elastic contacting part, the retaining force can be equally provided to each of the first elastic contacting parts of each of the first terminal members. Furthermore, by separating a pair of the first terminal members and by separating the pair of second terminal members, the assembly procedure could be simpler showing that the cable can be directly connected to each of the cable connecting parts without any upside and downside clamping structure to deal with difficulties and complicated process of assembling in prior arts.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
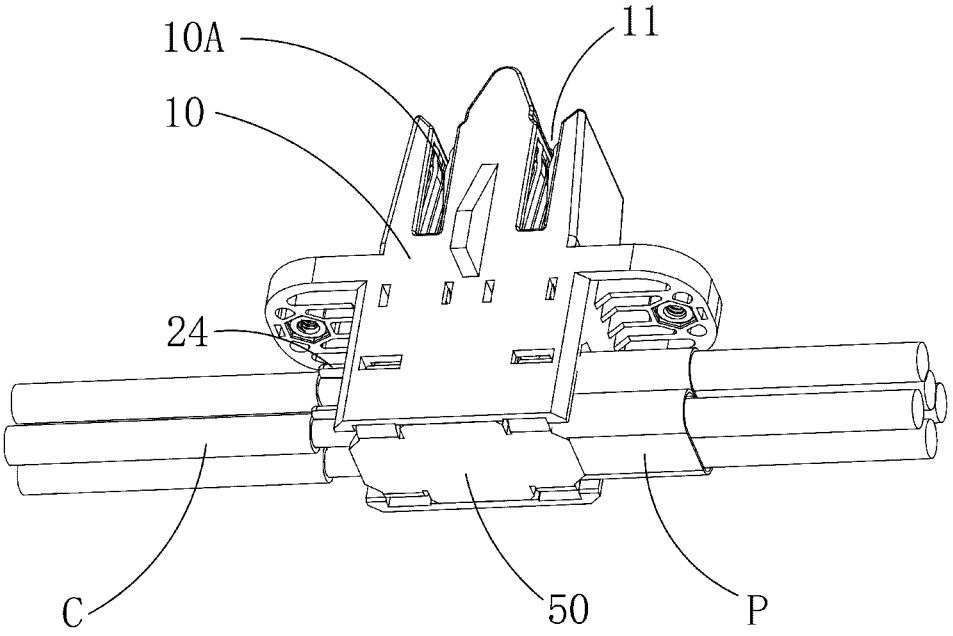
FIG. 1 is a perspective view of an electrical connector of the first embodiment of the present disclosure.
Figure 2:
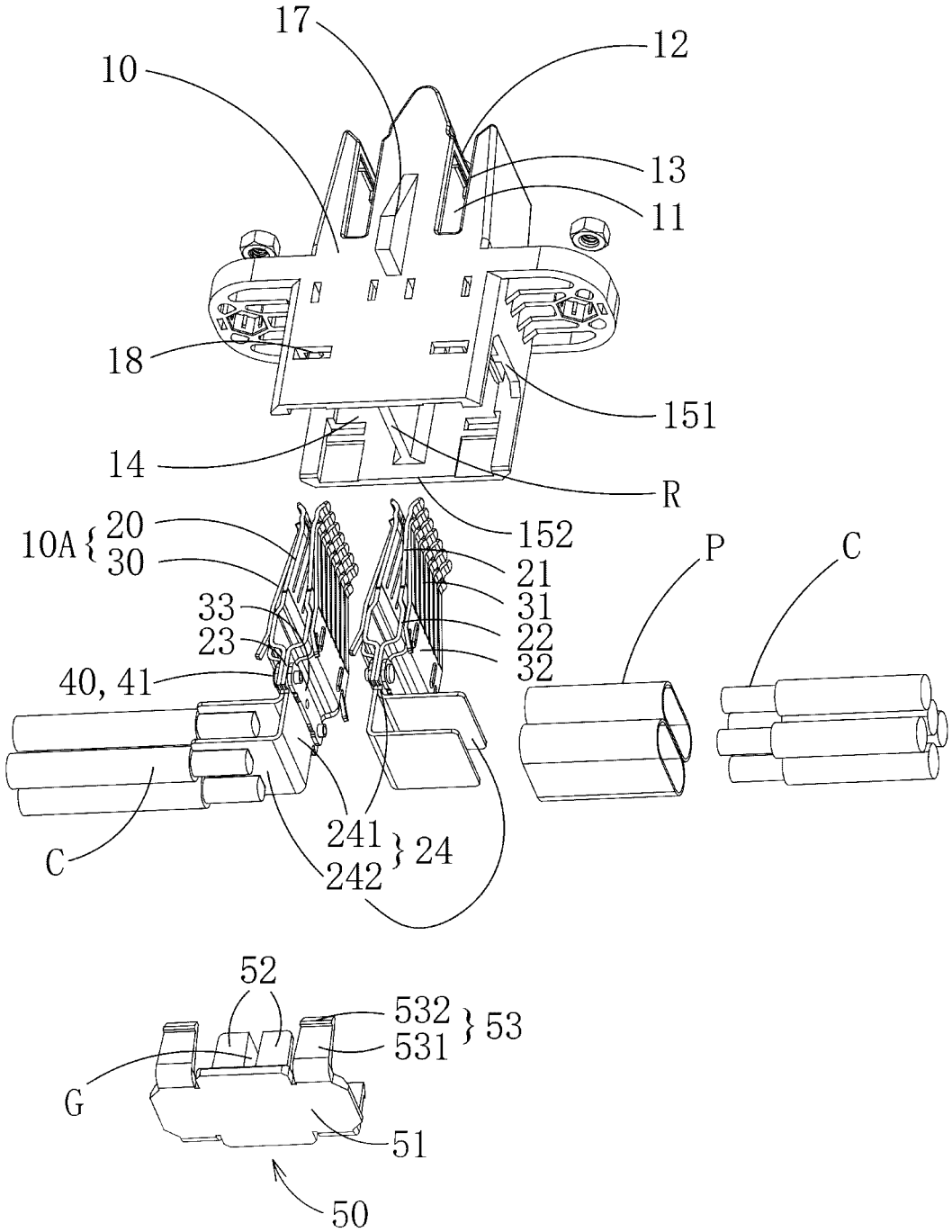
FIG. 2 is an exploded view of the electrical connector of FIG. 1.
Figure 3:
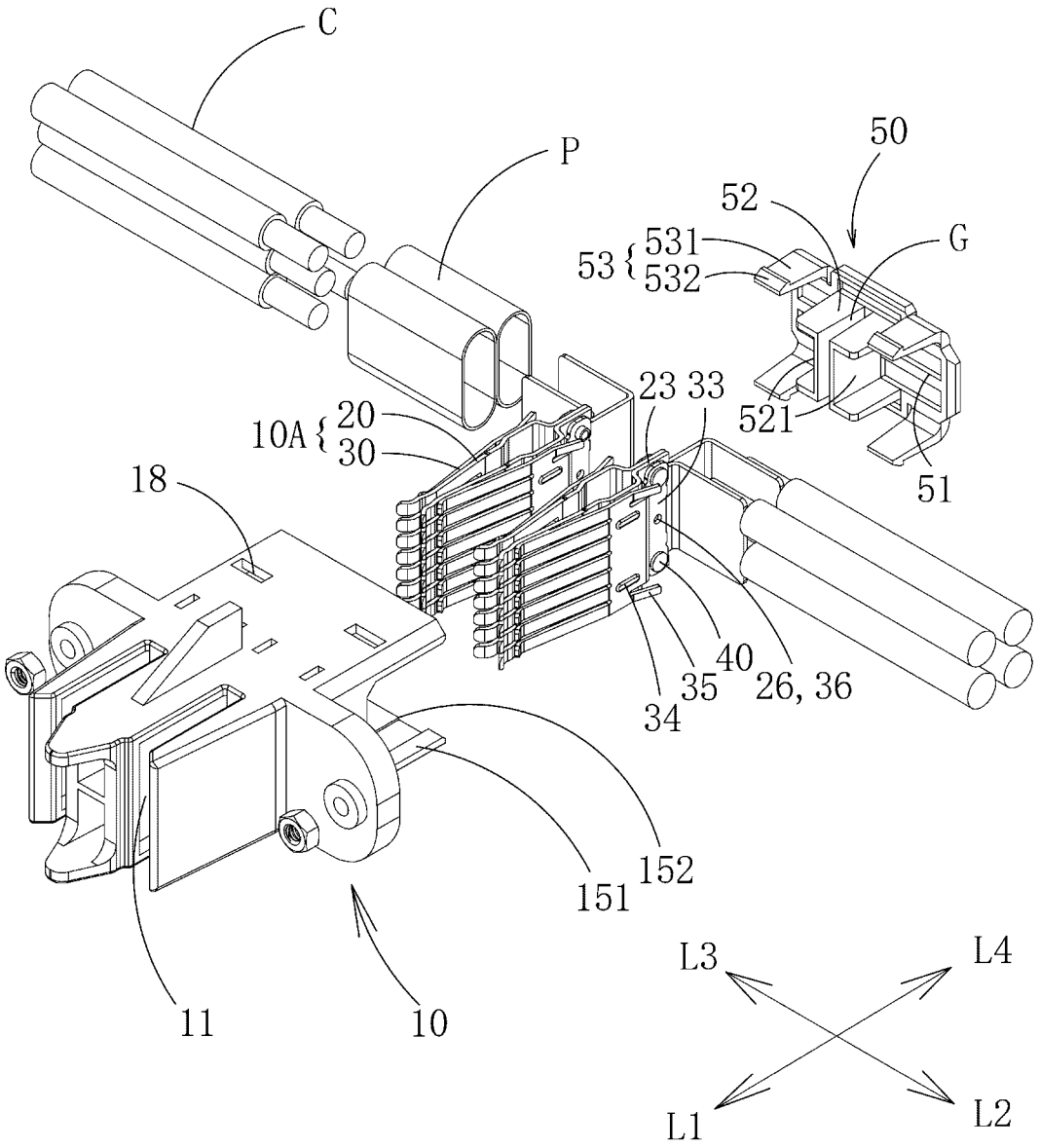
FIG. 3 is another exploded view of the electrical connector of FIG. 1.

FIG. 1 is a perspective view of an electrical connector of the first embodiment of the present disclosure. FIG. 2 and FIG. 3 are exploded views of the electrical connector of FIG. 1. As shown in the figures, the electrical connector of the present disclosure comprises an insulating body 10 and a plurality of terminal components 10A. The insulating body 10 comprises a mating slot 11. Specifically, the insulating body 10 comprises two mating slots 11. The two mating slots 11 are disposed in parallel and extend in a first direction L1. The plurality of terminal components 10A are respectively assembled with the plurality of mating slots 11. In this embodiment, the number of the terminal components 10A is two, each of which comprises a pair of first terminal members 20, a pair of second terminal members 30, and a fixing component 40. The pair of first terminal members 20 are disposed in the mating slot 11. Each of the first terminal members 20 comprises a plurality of first elastic contacting parts 21. The second terminal member 30 is disposed in the mating slot 11. The first terminal member 20 is disposed between the second terminal members 30. Each second terminal members 30 comprises a plurality of second elastic contacting parts 31 correspondingly abut against the plurality of first elastic contacting parts 21. The fixing component 40 fixes the first terminal member 20 and the second terminal member 30.

As shown in FIG. 2, the insulating body 10 can be formed by inject-molding. In the insulating body 10, a mating slot 11 is provided. A plugging port 12 is provided in front of the mating slot 11. The opposite two sidewalls of the mating slot 11 are respectively provided with an opening 13. The opening 13 communicates with the plugging port 12 so that the copper bar can be inserted into the mating slot 11 through the plugging port 12 and the opening 13. The insulating body 10 further comprises an accommodating groove 14 connected to the mating slot 11, allowing the first terminal member 20 and the second terminal member 30 fixed to the first terminal member 20 to be installed in the insulating body 10 through the accommodating groove 14 to accommodate the cable C connected with the first terminal member 20. Besides, the insulating body 10 further comprises an anti-misconnect component 17 disposed asymmetrically relative to the mating slot 11. In this embodiment, the anti-misconnect component 17 comprises a bump disposed on an outer sidewall of the insulating body 10, specifically on one outer sidewall of the insulating body 10. When the electrical connector of the present disclosure is connected to the corresponding electrical connector on the copper bar, misconnection could be avoided through the corresponding insertion of the bump into the groove of the corresponding electrical connector on the copper bar.

Figure 4:
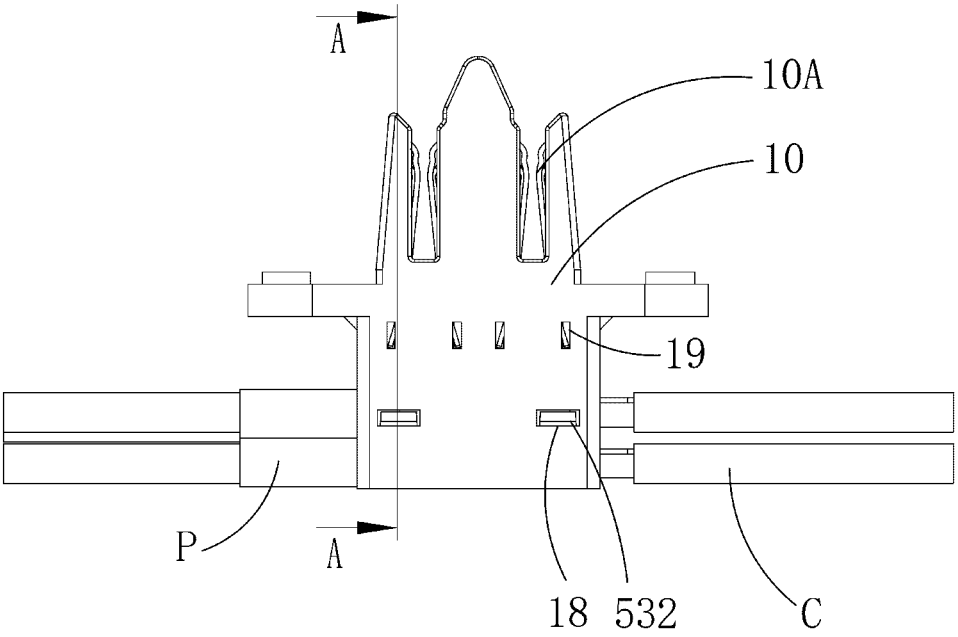
FIG. 4 is a bottom view of the electrical connector of FIG. 1.
Figure 5:
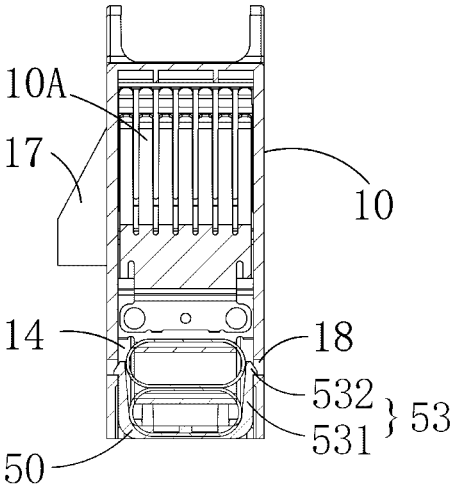
FIG. 5 is a cross-sectional view along line A-A' in FIG. 4.
Figure 6:
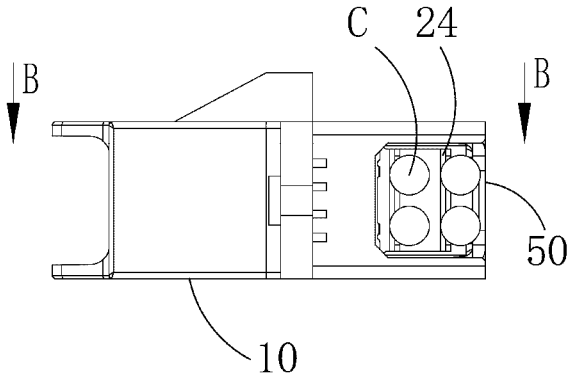
FIG. 6 is a side view of the electrical connector of FIG. 1.
Figure 7:
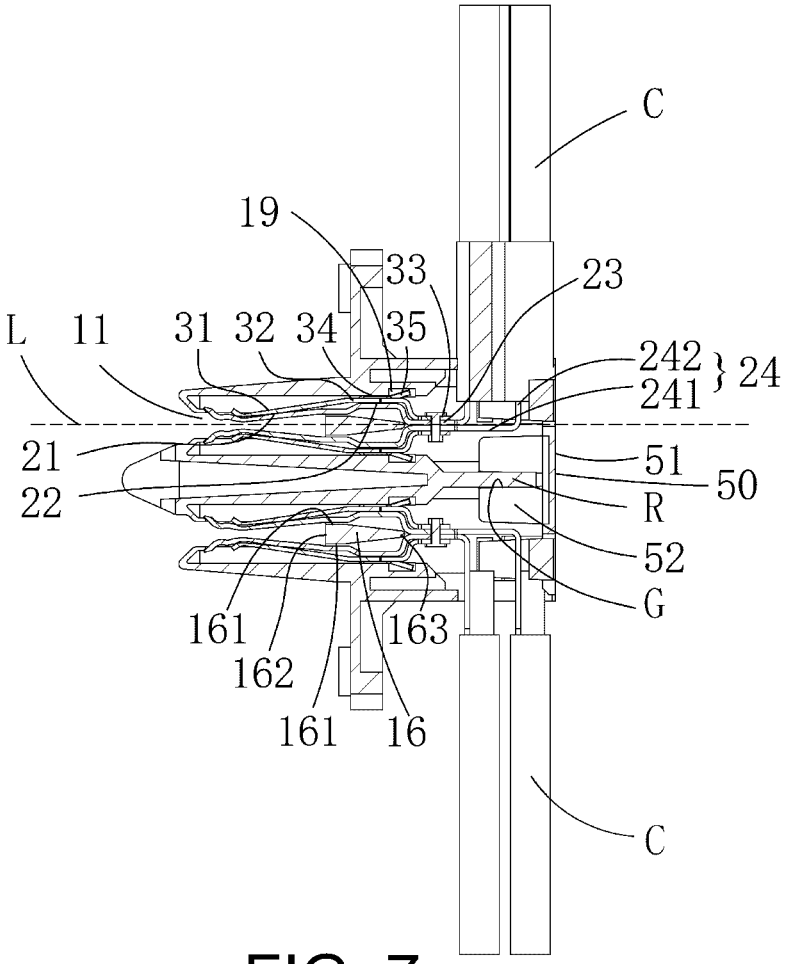
FIG. 7 is a cross-sectional view along line B-B' in FIG. 6.

FIG. 4 is a bottom view of the electrical connector of FIG. 1. FIG. 5 is a cross-sectional view along line A-A' in FIG. 4. FIG. 6 is a side view of the electrical connector of FIG. 1. FIG. 7 is a cross-sectional view along line B-B' in FIG. 6. Referring to FIGS. 4 to 7 and FIG. 2, the first terminal member 20 and the second terminal member 30 are inserted into the mating slot 11 of the insulating body 10, and the second terminal member 30 is closer than the first terminal member 20 to the slot wall of the mating slot 11. The first terminal member 20 can be detachably disposed, and the second terminal member 30 can be detachably disposed. In this way, the first terminal member 20 and the second terminal member 30 can be correspondingly assembled in order during assembly, and the process can be relatively simple.

As shown in FIG. 2 and FIG. 7, each of the first elastic contacting parts 21 is an elastic contacting arm, and each of the second elastic contacting parts 31 is also an elastic contacting arm. In this embodiment, the first terminal member 20 is symmetrically disposed with respect to a centerline L of the mating slot 11. The centerline L of the mating slot 11 is defined as a line in the mating slot 11 that extends along the copper bar plugging direction and is equally distant from an upper and lower walls of the mating slot 11. Similarly, the second terminal member 30 is also symmetrically disposed with respect to the centerline L of the mating slot 11. Each of the second elastic contacting parts 31 abuts against the corresponding first elastic contacting part 21. When the copper bar is inserted into the mating slot 11, the first elastic contacting part 21 would be pushed by the copper bar to be elastically deformed. The elastic force generated by the elastic deformation presses against the conductive metal terminals of the copper bar, thereby to be electrically connected with the copper bar. Due to the insertion of the copper bar, the second elastic contacting part 31 can also be elastically deformed to press against the first elastic contacting part 21. In this way, a retaining force can be provided to the first elastic contacting part 21. Since a retaining force is individually provided to each of the first elastic contacting parts 21 by the second elastic contacting part 31, each of the first elastic contacting parts 21 of each of the first terminal members 20 can be averagely provided with a retaining force. Besides, in this embodiment, the first elastic contacting parts 21 of the two first terminal members 20 respectively abut against the two sidewalls 161 of the stopping block 16 of the insulating body 10.

Each of the first terminal members 20 further comprises a first abutting part 22, and the first elastic contacting part 21 is connected to the first abutting part 22. Each of the second terminal members 30 comprises a second abutting part 32. The second elastic contacting part 31 is connected to the second abutting part 32. In this embodiment, the first abutting part 22 is bent plate-shaped. The first elastic contacting part 21 is connected to one side edge of the first contacting part 22 and extends toward the plugging port 12 of the mating slot 11 from the side edge. Each of the first elastic contacting parts 21 gradually approaches the centerline L of the mating slot 11 from the side edge of the first abutting part 22 in an inclined way. The first abutting parts 22 of the two first terminal members 20 are oppositely disposed. As described above, the two first terminal members 20 are symmetrically disposed with respect to the centerline L, and the stopping block 16 is sandwiched between the two first abutting parts 22. Thus, when the copper bar is inserted in the mating slot 11, the first elastic contacting part 21 is pressed to be elastically deformed by the thickness of the copper bar. Besides, in this embodiment, the second abutting part 32 abuts against the first abutting part 22. In addition to the retaining force of the second elastic contacting part 31 pressing against the first elastic contacting part 21, it can be provided on another point of the first abutting part 22 by the second abutting part 32 to allow the second terminal member 30 to integrally provide an excellent retaining force to the first terminal member 20.

As shown in FIGS. 2 and 3, each of the first terminal members 20 further comprises a first fixing part 23 connected to the first abutting part 22, and each of the second terminal members 30 further comprises a second fixing part 33 connected to the second abutting part 32. The first fixing part 23 is recessing in a direction toward the center line L, and the second fixing part 33 is also recessing in the direction toward the centerline L. Thus, one of the first fixing parts 23 of the two first terminal members 20 can abut against the other first fixing part, and the second fixing part 33 of each of the second terminal members 30 abuts against the first fixing part 23 of the corresponding first terminal member 20. The fixing component 40 fixes the first fixing part 23 and the second fixing part 33. The fixing component 40 comprises at least one fixing member 41. The first fixing part 23 is connected to the second fixing part 33 through the at least one fixing member 41. In this embodiment, the fixing member 41 can be a rivet or a bolt passing through the through holes on the first fixing part 23 and the second fixing part 33 to fix the two first terminal members 20, and to fix the second terminal member 30 on the corresponding first terminal member 20. In other embodiments, the fixing component could be a soldering or ultrasonic welding component which fixes the first fixing part 23 and the second fixing part 33. The first positioning hole 26 is provided at the first fixing part 23 and in the center thereof, and the second positioning hole 36 is provided at the second fixing part 33 and in the center thereof. The position of the first positioning hole 26 corresponds to the position of the second positioning hole 36. The first positioning hole 26 and the second positioning hole 36 can be passed through by a positioning rod of a machine to perform positioning during the welding manufacturing process described hereinafter. Besides, in this embodiment, when the first terminal member 20 and the second terminal member 30 are inserted into the insulating body 10, the two opposite first fixing parts 23 would abut against a second end part 163 of the stopping block 16. The first terminal member 20 and the second terminal member 30 are fixedly combined through the fixing component 40.

As shown in FIG. 2, each of the first terminal members 20 further comprises a cable connecting part 24 connected to the first fixing part 23. In this embodiment, each of the cable connecting parts 24 is an L-shaped plate and comprises an extending section 241 and a binding section 242. The extending section 241 is connected to and extends from the first fixing part 23, and the binding section 242 is connected to the extending section 241 and forms an angle with the extending section 241. In this embodiment, the extending section 241 is orthogonal to the binding section 242, and the extending sections 241 of the cable connecting part 24 of the pair of first terminal members 20 are different in length. That is, the length of one first terminal member 20 is greater than the length of the other first terminal member 20, allowing a gap, existing between the coupling sections 242 of the two first terminal members 20, is equal to the length difference between the extending sections 241 of the two first terminal members 20. The gap accommodates the cable C. The cable C is connected to the cable connecting part 24 of the first terminal member 20. When the first terminal member 20, the second terminal member 30, and the cable C are inserted into the insulating body 10, the cable connecting part 24 and the cables C connected to the two cable connecting parts 24 would be accommodated in the accommodating groove 14 of the insulating body 10. In this embodiment, wires of the cable C can be welded to the binding section 242 of the cable connecting part 24 by ultrasonic welding to avoid false welding during traditional welding. The first positioning hole 26 and the second positioning hole 36 allow the penetrating and positioning by the positioning rod of the machine during the process of the cable connecting part 24 welding to the cable C. A heat shrink tube P could be used to cover where the cable C is welded to the cable connecting part 24 (see FIG. 1) to protect and insulate the wire part of the cable C and the cable connecting part 24 that are welded together.

As shown in FIG. 2 and FIG. 3, in this embodiment, the insulating body 10 is provided with two mating slot 11 to be inserted by two terminal components 10A. The binding section 242 of the cable connecting part 24 of the pair of first terminal members 20 of one terminal component 10A extends along a second direction L2, and the cable connecting part 24 of the pair of first terminal members 20 of another terminal component 10A extends along a second direction L3. The second direction L2 and the third direction L3 intersect with the first direction L1, respectively. In this embodiment, the second direction L2 is an opposite direction of the third direction L3, and the second direction L2 and the third direction L3 are respectively orthogonal to the first direction L1.

As shown in FIG. 2 and FIG. 3, in addition to extend in the second direction L2 and the third direction L3 opposite to the cable connecting part 24 of the two first terminal members 20, the insulating body 10 also comprises a pair of lateral openings 151. The pair of lateral openings 151 communicates with the accommodating groove 14 and are respectively facing outward in the second direction L2 and the third direction L3. In this embodiment, the pair of lateral openings 151 are disposed on two opposite surfaces of the insulating body 10. The plurality of cables C are respectively connected to the binding section 242 of the cable connecting part 24 extending in the second direction L2 and the binding section 242 of the cable connecting part 24 extending in the third direction L3 through the pair of lateral openings 151.

Besides, the insulating body 10 further comprises a rear end opening 152. The rear end opening 152 communicates with the accommodating groove 14 and faces outward in a fourth direction L4. The fourth direction L4 is an opposite direction to the first direction. The rear end opening 152 and the mating slot 11 are disposed on opposite surfaces of the insulating body 10. In this embodiment, the rear end opening 152 also communicates with the pair of lateral openings 151.

In this embodiment, the electrical connector further comprises a rear cover 50, which closes the rear end opening 152. The rear cover comprises a rear cover body 51, a pair of supporting parts 52, and a plurality of engaging parts 53. As shown in FIG. 6 and FIG. 7, when the rear cover body 51 covers the rear end opening 152, the pair of the supporting parts 52 and the plurality of the engaging parts 53 would extend in the first direction L1 from the rear cover body 51. The supporting part 52 is disposed between the cable connecting part 24 extending in the second direction L2 and the cable connecting part 24 extending in the third direction L3, and respectively support the cable connecting part 24 extending in the second direction L2 and the cable connecting part 24 extending in the third direction L3. The rear cover body 51 is flat-shaped to abut against the insulating body 10 to cover the rear end opening 152. The supporting part 52 stands upright on the rear cover body 51. Each of the supporting parts 52 comprises an accommodating recess 521. The accommodating recesses 521 of the pair of the supporting parts 52 respectively facing the second direction L2 and the third direction L3 to accommodate the cable connecting part 24 extending in the second direction L2 and the cable connecting part 24 extending in the third direction L3. A gap G exists between the pair of supporting parts 52. When the rear cover body 51 covers the rear end opening 152, a rib R of the insulating body 10 is inserted into the gap G, and the supporting part 52 rests on the rib R. When the cable C is forced to push the cable connecting part 24 of the first terminal member 20, the supporting part 52 can support the cable connecting part 24 by which to be rested on the supporting part 52 to keep undeformed. Besides, as shown in FIG. 4 and FIG. 5, the engaging part 53 comprises an elastic arm 531 and an engaging bump 532. The elastic arm 531 is connected to the rear cover body 51. The engaging bump 532 is disposed at a free end of the elastic arm 531. When the rear cover body 51 covers the rear end opening 152, the elastic arm 531 would enter the accommodating groove 14, and the engaging bump 532 would be engaged with the engaging slot 18 of the insulating body 10.

As shown in FIG. 7, a stopping block 16 is disposed in the mating slot 11. The stopping block 16 is between the mating slot 11 and the accommodating groove 14, and the stopping block 16 comprises two opposite sidewalls 161, a first end part 162, and a second end 163 opposite to the first end part 162. The two sidewalls 161 are inclined to facilitate the insertion of the terminals into the mating slot 11. The first end 162 is facing to the mating slot 11, and the second end 163 is facing to the accommodating groove 14 and is away from the mating slot 11.

As shown in FIG. 3 and FIG. 7, each of the second terminal members 30 comprises at least one rib 34 disposed at the second abutting part 32 and protrudes toward the insulating body 10. When the fixedly combined first terminal member 20 and second terminal member 30 are inserted into the mating slot 11, the rib 34 of the second terminal member 30 would abut against the slot wall of the mating slot 11. As described above, the first elastic contacting parts 21 of the first terminal member 20 respectively abut against the two sidewalls 161 of the stopping block 16 of the insulating body 10. In this way, the fixedly combined first terminal member 20 and second terminal member 30 can be limited in the direction perpendicular to the centerline L.

As shown in FIG. 3 and FIG. 7, each of the second terminal members 30 comprises at least one buckling part 35. The buckling part 35 is disposed at the second abutting part 32 and extends toward the insulating body 10. The insulating body 10 comprises at least one engaging slot 19 with which the buckling part 35 is engaged. The engaging slot 19 is provided on the slot wall of the mating slot 11. The buckling parts 35 are disposed on two opposite side edges of the second abutting part 32 and protrude in a direction away from the second abutting part 32. When the fixedly combined first terminal member 20 and second terminal member 30 are inserted into the mating slot 11, the buckling part 35 would be engaged with the engaging slot 19 of the insulating body 10. In this way, the fixedly combined first terminal member 20 and second terminal member 30 can be limited in the direction along the centerline L.

Figure 8:
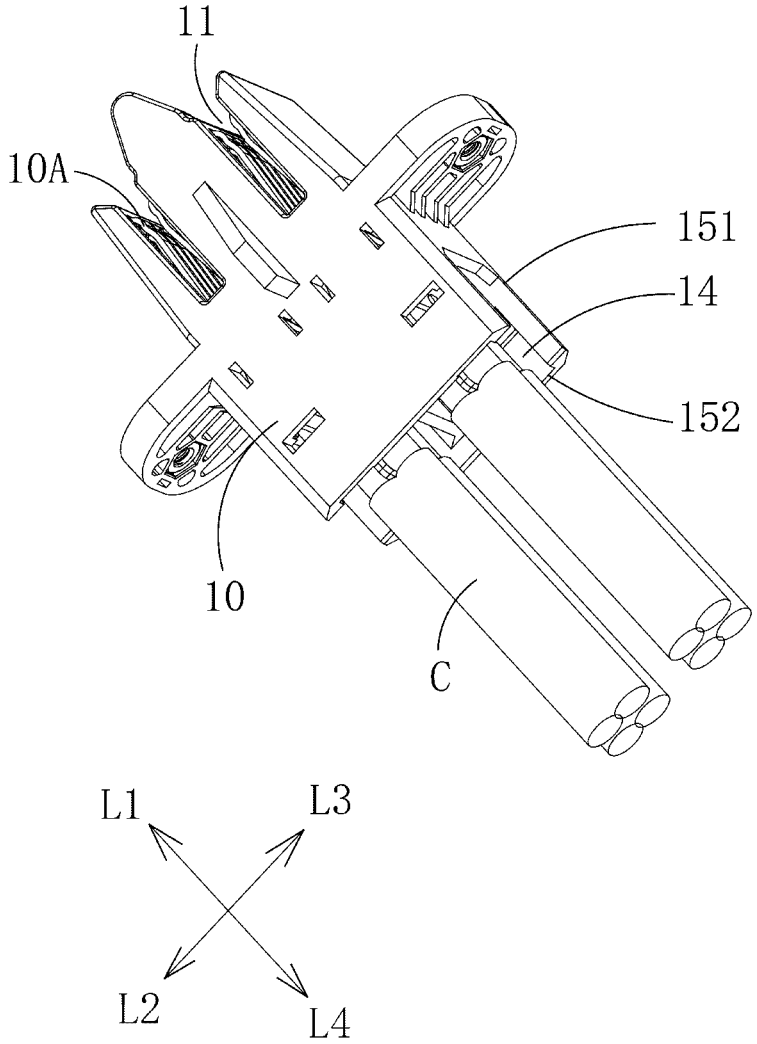
FIG. 8 is a perspective view of an electrical connector of the second embodiment of the present disclosure.
Figure 9:
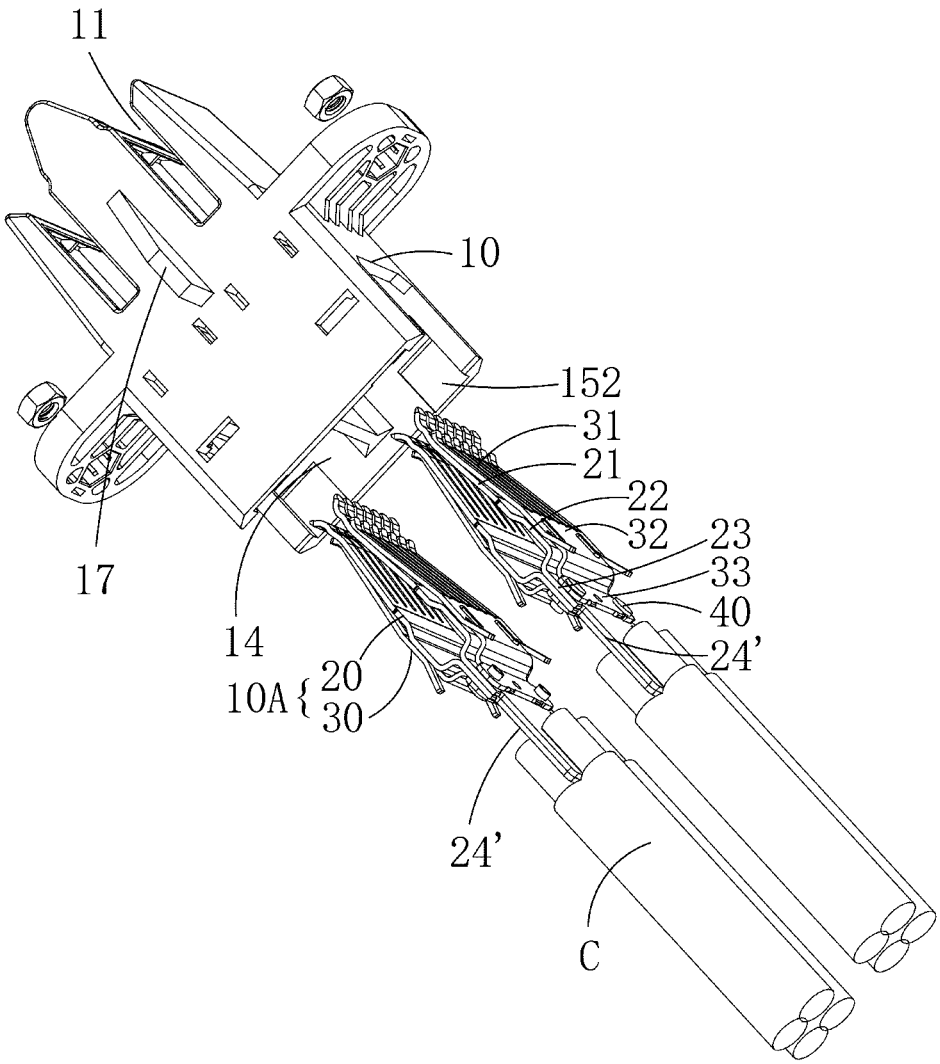
FIG. 9 is a partial exploded view of the electrical connector of FIG. 8.

FIG. 8 is a perspective view of an electrical connector of the second embodiment of the present disclosure. FIG. 9 is a partial exploded view of the electrical connector of FIG. 8. The parts of this embodiment that are identical to those in the first embodiment are denoted by the same symbols and the description would be omitted. The difference between this embodiment and the first embodiment is that the cable connecting parts 24' of the first terminal member 20 are flat-shaped and are overlappingly stacked. Moreover, the cable connecting parts 24' of the pair of first terminal members 20 extend in a fourth direction L4, which indicates that the extending directions of the cable connecting parts 24' are opposite to the first elastic contacting part 21, and the cable C connects to the cable connecting part 24' through the rear end opening 152 of the insulating body 10. The cable connecting part 24' can be combined with the cable C by ultrasonic welding to avoid false welding during traditional welding.

In summary, embodiments of the present disclosure provide an electrical connector. The first terminal member is disposed between the second terminal members, and the second elastic contacting part of the second terminal member correspondingly abuts against the first elastic contacting part of the first terminal member. In this way, the second terminal member could apply a retaining force to the first terminal member, allowing the first terminal member can be kept in contact with the copper bar. Besides, since the retaining force to each of the first elastic contacting parts is respectively provided by individual second elastic contacting part, the retaining force can be equally provided to each of the first elastic contacting parts of each of the first terminal members. Furthermore, by separating a pair of the first terminal members and by separating the pair of second terminal members, the assembly procedure could be simpler than ordinary processes. Since the cables are directly connected to each of the cable connecting parts by welding without any fastening components to deal with difficulties and complicated processes of assembling in prior arts.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

an insulating body comprising a mating slot extending along a first direction;

two terminal components disposed in the mating slot, respectively comprising a pair of first terminal members and a pair of second terminal members, the pair of first terminal members being disposed between the pair of second terminal members, each of the first terminal members comprising a plurality of first elastic contacting parts, a first fixing part and a cable connecting part, each of the second terminal members comprising a plurality of second elastic contacting parts and a second fixing part, the plurality of second elastic contacting parts correspondingly abutting the plurality of first elastic contacting parts; and a fixing component fixing the pair of the first terminal members and the pair of the second terminal members, the first fixing part being connected with the second fixing part through the fixing component;

wherein a cable is directly connected to each of the cable connecting parts; the cable connecting part is flat-shaped;

wherein the cable connecting part of the pair of the first terminal members of one terminal component extends in a second direction; the cable connecting part of the pair of the first terminal members of another terminal component extends in a third direction; the second direction and the third direction are respectively orthogonal to the first direction.

2. The electrical connector according to claim 1, wherein the number of the mating slots and the two terminal components is multiple; the two terminal components are correspondingly connected to the plurality of mating slots, respectively.

3. The electrical connector according to claim 2, wherein the insulating body comprises an accommodating groove communicating with the plurality of mating slots; the cable connection part is disposed in the accommodating groove.

4. The electrical connector according to claim 1, wherein the second direction is an opposite direction to the third direction.

5. The electrical connector according to claim 1, wherein the insulating body comprises a pair of lateral openings; the pair of lateral openings communicate with the accommodating groove and are respectively facing outward in the second direction and the third direction; the plurality of cables are respectively connected to the cable connecting part extending in the second direction and the cable connecting part extending in the third direction through the pair of lateral openings.

6. The electrical connector according to claim 5, wherein the insulating body comprises a rear end opening; the rear end opening communicates with the accommodating groove and faces outward in a fourth direction; the fourth direction is an opposite direction to the first direction.

7. The electrical connector according to claim 6 further comprising a rear cover closing the rear end opening; wherein the rear cover comprises a rear cover body, a pair of supporting parts, and a plurality of engaging parts; the rear cover body covers the rear end opening; the pair of the supporting parts and the plurality of the engaging parts extend in the first direction from the rear cover body; the pair of supporting parts are disposed between the cable connecting part extending in the second direction and the cable connecting part extending in the third direction; the pair of supporting parts respectively support the cable connecting part extending in the second direction and the cable connecting part extending in the third direction; the engaging part engages with an engaging slot of the insulating body.

8. The electrical connector according to claim 7, wherein a gap exists between the pair of supporting parts; a rib of the insulating body is inserted in the gap.

9. The electrical connector according to claim 7, wherein the pair of supporting parts respectively comprise an accommodating recess; the accommodating recesses of the pair of the supporting parts respectively correspond to the cable connecting part extending in the second direction and the cable connecting part extending in the third direction.

10. The electrical connector according to claim 1 further comprising a heat shrink tube covering the joint of the cable and the cable connecting part.

11. An electrical connector, comprising:

an insulating body comprising a mating slot;

a terminal component disposed in the mating slot, comprising a pair of first terminal members and a pair of second terminal members, the pair of first terminal members being disposed between the pair of second terminal members, each of the first terminal members comprising a plurality of first elastic contacting parts, a first fixing part and a cable connecting part, each of the second terminal members comprising a plurality of second elastic contacting parts and a second fixing part, the plurality of second elastic contacting parts correspondingly abutting the plurality of first elastic contacting parts; and a fixing component fixing the pair of the first terminal members and the pair of the second terminal members, the first fixing part being connected with the second fixing part through the fixing component;

wherein a cable is directly connected to each of the cable connecting parts; the cable connecting part is flat-shaped;

wherein the first fixing part comprises a first positioning hole disposed at the center of the first fixing part.

12. The electrical connector according to claim 11, wherein the second fixing part comprises a second positioning hole disposed at the center of the second fixing part.

* * * * *